United States Patent [19]

Magnusson

[11] Patent Number: 4,768,667

[45] Date of Patent: Sep. 6, 1988

[54] TEAR-OFF CONTAINER CLOSURE

[75] Inventor: Sven-Ake Magnusson, Kungalv, Sweden

[73] Assignee: Wicanders Closures AG, Zug, Switzerland

[21] Appl. No.: 119,103

[22] Filed: Nov. 10, 1987

Related U.S. Application Data

[63] Continuation-in-part of Ser. No. 38,227, Apr. 14, 1987.

[30] Foreign Application Priority Data

Nov. 17, 1986 [SE] Sweden ..... 8604926

[51] Int. Cl.[4] ..... B65D 41/42

[52] U.S. Cl. ..... 215/255; 215/304

[58] Field of Search ..... 215/255, 254, 303, 304

[56] References Cited

U.S. PATENT DOCUMENTS

| | | | |
|---|---|---|---|
| 2,046,173 | 6/1936 | Lenhoff | 215/304 |
| 3,206,055 | 9/1965 | Helbing | 215/303 |
| 4,149,647 | 4/1979 | Ritzenfoff | 215/254 |
| 4,453,644 | 6/1984 | Berglund | 215/255 |

FOREIGN PATENT DOCUMENTS

| | | | |
|---|---|---|---|
| 343830 | 2/1931 | United Kingdom | 215/254 |

*Primary Examiner*—Donald F. Norton

*Attorney, Agent, or Firm*—Brumbaugh, Graves, Donohue & Raymond

[57] ABSTRACT

A tear-off container closure, such as a cap for sealing bottles, has an upper covering panel, a cylindrical cap skirt, a tear-off strip defined by score lines in the covering plate and cap skirt. The strip continues as (a) a tongue protruding outside the cap skirt and (b) a pulling member joined to the tongue of the tear-off strip. The pulling member includes a connecting portion, made of plastic. This connecting portion is joined to the tongue of the tear-off strip to form a joint between tongue and connecting portion which joint is resistant to tensile and torsional stress. The outwardly directed side of the joint is also provided with a protruding spacer, the upper operative surface of which is spaced from the root of the tongue by a distance substantially less than the height of the cap skirt.

14 Claims, 5 Drawing Sheets

TEAR-OFF CONTAINER CLOSURE

This application is a continuation-in-part of pending application Ser. No. 38,227, filed Apr. 14, 1987.

FIELD OF THE INVENTION

The invention relates to a tear-off closure for sealing containers such as bottles, comprising an upper covering panel, a cylindrical skirt, a tear-off strip defined by score lines in the covering panel and the skirt, said strip continuing as a tongue protruding outside the skirt, and a pulling member connected to the tongue of the tear-off strip.

PRIOR ART

Bottle caps of the type described above are already known in various forms. Tear-off caps with pulling members are thus available in which the pulling member and cap are manufactured in one piece, and so are two part caps in which the cap portion is made of metal while the pulling member may be of metal or plastic.

However, all the known caps have drawbacks.

One serious such drawback becomes apparent when the lower portion of the cap skirt is in various ways pressed in under the flange around the mouth of the bottle. This process causes total or partial deformation of the start of the score lines so that, in a proportion of cases occurring with a frequency which can even be established statistically, these score lines become closed. This means that considerably greater force is required to tear along the score lines or —even worse —it leads to uncontrolled tearing at the tongue root due to one or both of the score lines having been blocked by said deformation at the start, and the tear is thus effected through unscored material. This closing or clenching of the start of the score lines often means that greater tensile forces are required to such an extent that the connection point between tongue and pulling member is subjected to such a great strain that the connection ruptures and the cap can no longer be removed.

Another serious problem with such known caps is that they do not permit pressure relief for carbonated drinks. If an overpressure is generated in such bottles there is a risk of the bottle exploding and causing serious injury. It should be pointed out here that the compressive strength of all types of bottles varies from one sample to the next due to the formation of cracks, as well as there being a certain frequency of inherent stress in newly manufactured glass bottles. Furthermore, the risk increases with returnable bottles where it can be statistically established that the compressive strength of glass bottles gradually decreases in proportion to the number of "trips" (i.e. the number of times such bottles are returned and re-used). Caps have therefore long been sought which could be provided with a venting function which would come into operation at the high pressure levels at which there would be a risk of the bottle exploding, but which would again provide a tight seal after such venting of dangerous overpressure, thus maintaining the quality of the carbonated drink. Conventionally designed tear-off caps lack such a venting function and, if too high a carbonation pressure is reached, either the cap will fly off the bottle mouth or —even worse —the bottle will explode. In both cases this entails obvious risks of personal injury.

Another drawback of conventional tear-off caps is that they can unwittingly be opened incorrectly, i.e. if the pulling member, which is supposed to lie against the neck of the bottle, is bent 180° vertically upwards before pulling is initiated. In this case extremely little leverage will be obtained close to the start of the score lines, and considerable tensile force will therefore be required. Not infrequently the force is so great that the pulling member comes off or the consumer deems the cap impossible to open. It is therefore a matter of urgency to find a technical solution to this problem, which will automatically give efficient leverage when the pulling member is bent up at an angle of 90°–180°.

The connecting portion between cap and pulling member constitutes a weak point in tear-off caps, regardless of whether the cap is manufactured in one piece or is made in two pieces with the cap and pulling member manufactured separately and being subsequently joined. A rupture in the connecting portion between cap and pulling member may be caused by repeated bending or twisting of the pulling member when the cap is opened, or during transport and handling of the cap during manufacture or when the cap is applied on the bottle if the connecting portion is subjected to repeated flexural stress. It is therefore important that the connecting portion is reinforced so as to withstand well the unavoidable stresses described above. Various types of reinforcement are known. The connecting portion has, for instance, been provided with various types of impressions in order to strengthen it. However, it is still desirable to find new methods of further improving and reinforcing the connecting portion in order to eliminate the difficulties described above.

Demands are constantly increasing for increased filling and sealing rates during production and the rate has increased over the past decade from 1000 bottles per minute to 1500 bottles per minute. This entails great difficulty in supplying and handling tear-off caps which are by their nature necessarily asymmetrical and are thus difficult to orientate at an equivalent speed so that the filling and sealing capacity is not retarded by the capping machines. Tear-off caps must therefore be designed in a manner permitting fast orientation on their way to the capping station.

A frequent problem with tear-off caps is that, if the pulling member does not lie flat against the neck of the bottle, the cap may be unintentionally torn during handling of the bottle, both during manufacture and at the retailers.

OBJECT OF THE INVENTION

The object of the present invention is to produce a cap of the type described above, in which the identified drawbacks are eliminated.

SUMMARY OF THE INVENTION

According to the invention it has now surprisingly proved possible to achieve this object, starting with the cap described above, if the pulling member includes a connecting portion made of plastic, said portion being joined to the tongue of the tear-off strip to form a joint between the tongue and connecting portion and being resistant to tensile and torsional stress, the outwardly directed side of the joint having a protruding spacer whose upper operative defining surface is spaced from the root of the tongue by a distance substantially less than the height of the cap skirt.

The cap proposed according to the invention, having between the pulling member and the tongue a connection resistant to twisting and bending, and having the connecting portion provided with a spacer, offers a number of important advantages.

By means of the extent, portion and height of the spacer, the pressure of the sealing fingers in the sealing sleeve of the bottle closing head can be specifically controlled to protect the start of the score lines at the root of the tongue. Too high a capping pressure can thus be avoided and the otherwise unavoidable deformation or clenching of the score lines eliminated. This ensures that all caps can be opened easily in controlled manner.

Leverage is automatically obtained through the proposed spacer and the design of the pulling member, irrespective of the method used when the pulling member is initially bent upwards and the spacer thus brought into contact with the cap skirt. Thanks to this leverage effect, considerably less force is required to open the score lines, resulting in smooth and controlled initial tearing of the score lines. The other score lines in the cap skirt remain intact, preventing the cap from flying off, which may otherwise happen when the high opening resistance obtained with small leverage results in sudden, uncontrolled tearing of the score lines in bottles containing highly pressurised carbonated contents.

A third important advantage is gained besides the two mentioned above. This is an effect long sought in caps of the type under discussion, and is that according to the invention, if the pressure in the bottle becomes too high, self-venting is obtained thus eliminating the risk of the bottle exploding. This self-venting is obtained by regulating the grip of the cap skirt over the spacer so that it is less there than around the rest of the cap skirt. The looser grip within the area of the spacer produces a valve which opens when the pressure in the bottle exceeds a certain level (e.g. 100 psi). When the pressure in the bottle drops again the remaining part of the cap skirt, which grips the neck of the bottle more firmly, will spring back so that the part of the cap acting as valve will again be brought into abutment with the mouth of the bottle and the valve action will cease. The extent of the valve action cover, and how tightly it grips, determine the overpressure at which the valve opens and closes.

The spacer employed in accordance with the present invention gives the following additional advantages:

- the automatic leverage effect at opening of the cap gives lower opening forces and thus a more easily opened cap,
- the extra material in the spacer reinforces the connecting portion and enhances the tensile and torsional strengths of the attachment,
- the cap is easier to orientate in the capping process, e.g. during the sorting process, since the spacer prevents it from assuming a steady position with the pulling member resting against the surface below, and
- the pulling member is pressed down flat against the neck of the bottle when the cap is applied, thus reducing the risk of unintentional opening when the bottle is being handled.

In the venting effect mentioned above, the valve action cover constitutes only a limited segment of the cap skirt since loosening the grip all around the cap would weaken the cap to such an extent that it would fly off at normal overpressure in the bottle. The valve cover functions as follows:

- if the pressure in the bottle becomes too high the valve cover will lift, allowing the overpressure to be expelled,
- the part of the cap skirt clamped tightly around the bottle-neck retains the cap on the mouth of the bottle during the venting period, preventing the cap from flying off, and
- when the overpressure in the bottle has returned to a suitable level after venting, the firmly clamped part of the cap skirt will give a spring back action which closes the temporary valve cover.

According to a preferred embodiment of the invention the spacer consists of one or more protrusions or of a shoulder extending substantially across the width of the connecting portion. The spacer should in this case be higher than the space available in the sealing fingers of the sealing sleeve so that the cap skirt will be clamped more loosely against the neck of the bottle across the connecting portion, thus providing the desired valve action cover. The extent of the spacer and the difference in height between the spacer and the space available in the sealing fingers of the sealing sleeve thus regulate:

- the extent of the valve action cover and thus its venting capacity, and
- the overpressure level at which the valve action cover will open and close again due to spring-back action.

According to a preferred embodiment of the invention the pulling member, with connecting portion and spacer, is formed at the same time as the connecting portion is attached to the tongue.

To ensure secure anchoring to the connecting portion, the tongue may be provided with through-holes, protruding flanges, barbs or the like, and may possibly be reinforced by a special varnish to improve adhesion.

According to another embodiment of the invention the cap tongue and pulling member are positioned at an angle of approximately 45°–90° in relation to the top of the cap, throughout the period from manufacture of the cap blank to the actual capping operation. This orientation of tongue and pulling member offers a number of advantages in handling the cap. For example, during manufacture and later during capping, the advantage is gained that no flexural stress will arise in the actual root of the tongue. Such flexural stress has been found to cause weakening of the material at the root, with the risk of the tongue being torn when the cap is to be opened. Another advantage is that the center of gravity of the cap is orientated towards its top, thus facilitating sorting and orientating at high speeds. As is known, conventional tongues are orientated substantially parallel to the top of the cap or at 0°–45° thereto. However, it should be emphasized that the principle of the invention can of course be applied with such known caps where the tongue is oriented 0°–45° to the top of the cap.

The preferred embodiment of the invention also gives the advantage that the metal tongue is covered on all sides by plastic, thus eliminating the risk of cuts being sustained by the consumer during the opening process.

According to a further embodiment of the invention, until the moment of use the pulling member may be suitably restrained in close contact with the bottle-neck by means of a breakable positioning member at least partially covering the pulling member.

This offers the advantages that the pulling member is secured during handling and that, upon receipt of the bottle, the consumer can ascertain that no attempt has been made to open the cap.

Other features of the invention are revealed in the features defined in the accompanying claims.

BRIEF DESCRIPTION OF THE DRAWINGS

The invention will be described in more detail in the following with reference to some embodiments shown by way of example in the accompanying drawings, in which:

FIGS. 6A to 8A show longitudinal sections along the line A—A in FIGS. 6 to 8;

FIGS. 9A to 11A show equivalent sections along the lines B—B in FIGS. 9, 10 and 11;

FIGS. 12A to 14A show corresponding sections according to the lines C—C in FIGS. 12, 13 and 14;

Figure 1:
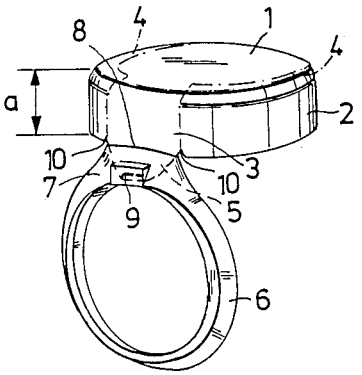
FIGS. 1 to 5 show various embodiments of the cap according to the invention, seen in perspective.
Figure 2:
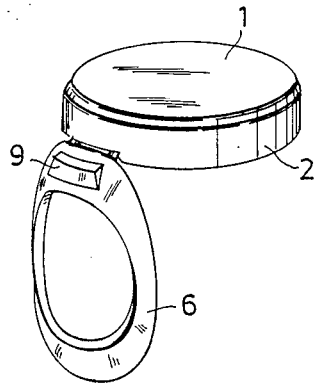

The same designations are used for equivalent parts in the drawings.

DESCRIPTION OF THE PREFERRED EMBODIMENTS

In principle, as shown in FIG. 1, the cap according to the invention comprises a covering panel 1, a cylindrical cap skirt 2, a tear-strip 3 with a tongue 5, protruding from the cap skirt, score lines 4 arranged in the cap, and a pulling member 6 attached to the tongue 5, the pulling member 6 being provided with a connecting portion 7 contiguous to the tongue. The height of the cap skirt is designated a and the tongue-root is 8. The pulling member consists of a plastic ring 6 which, with the aid of the connecting portion 7 integrated with the pulling member 6, is secured to the tongue 5 in a manner resistant to tensile and torsional stresses. The connecting portion in this connection extends close to the tongue-root, and preferably encloses the tongue on all sides. The connecting portion 7 is also provided with a protruding spacer 9. The starts of the score lines at the lower limit of the cap skirt are designated 10.

Of course the invention is not limited to the particular arrangement of the score lines shown in FIG. 1, and they could very well be arranged in various ways across the top of the cap. For this reason they have been omitted in most of the subsequent Figures.

Figure 3:
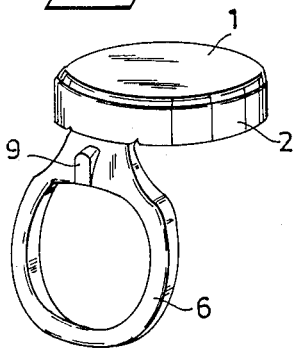
Figure 4:
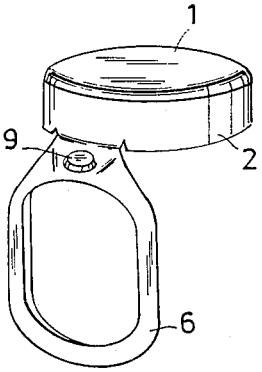
Figure 5:
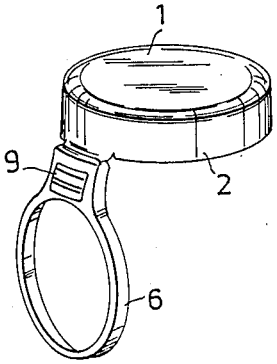

FIGS. 2 to 5 show examples of various embodiments of the spacer 9. Common to all these embodiments is that the operative area of the spacer is spaced from the tongue-root by a distance which is less than the height a of the cap skirt 2. In the embodiment shown in FIG. 2 the spacer 9 consists of a shoulder-like protrusion extending across the width of the connecting portion. FIG. 3 shows an embodiment with a single, centrally arranged protrusion, and in FIG. 4 the spacer is almost oval in shape and has a relatively large contact surface. The spacer shown in FIG. 5 has several contact surfaces.

The spacer may of course be shaped in numerous ways within the scope of the invention.

The important thing is that its operative surface is located at the distance stated above from the tongue-root, that it is given suitable height and lateral extent, and that it is manufactured in one piece with the connecting portion. The height of the spacer from the plane of the tongue can be in the order from 1 to 5 mm, for example, from 2 to 3 mm.

The cap shown in FIGS. 1 to 5 is provided with an annular pulling member but other designs have been utilized. Obviously the pulling member does not necessarily have to be annular but in principle may be any shape whatsoever, although the ring is a preferred embodiment.

Figure 6A:
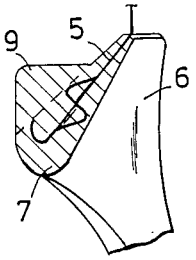
Figure 6:
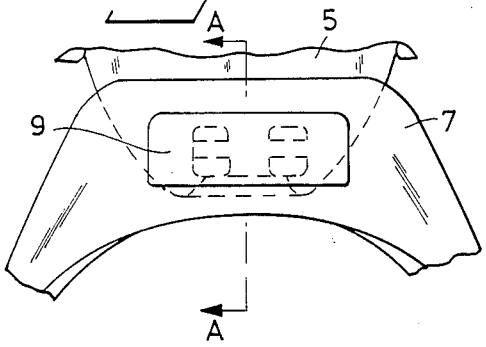
FIGS. 6 to 8 show enlargements of details of various embodiments of the joint between tongue and pulling member.
Figure 7A:
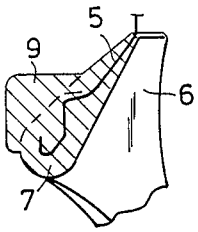
Figure 7:
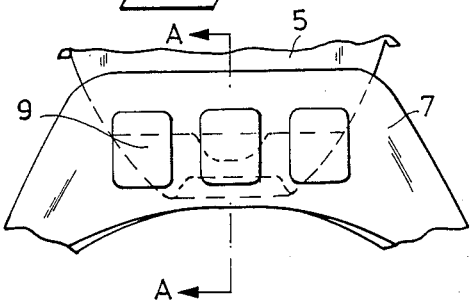
Figure 8A:
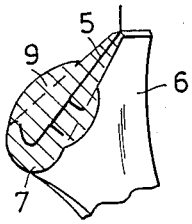
Figure 8:
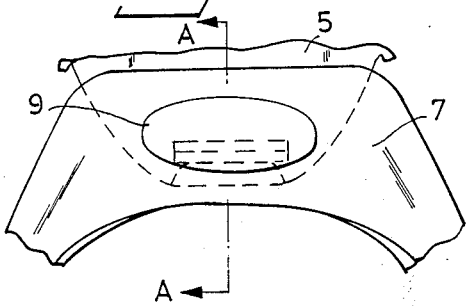

FIGS. 6 to 8 show, on an enlarged scale, the actual connection between the connecting portion 7 and the tongue with various embodiments of the spacer, and FIGS. 6A, 7A and 8A show a section taken along the line A—A in FIGS. 6, 7 and 8, respectively.

Further examples of the design of spacer 9 are shown in FIGS. 6, 7 and 8, and FIGS. 6A, 7A and 8A show suitable deformations and impressions of the tongue 5 to reinforce the connection against tensile and torsional forces.

The various embodiments of the spacer may of course be combined with various deformations of the tongue, and the invention is not limited rn this respect to the examples shown in the drawings.

Figure 9A:
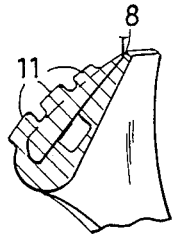
Figure 9:
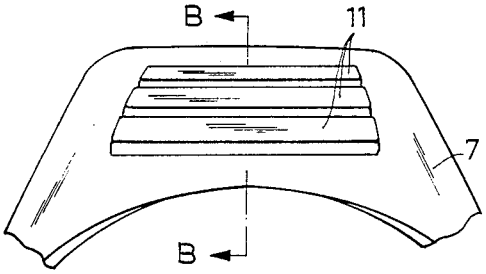
FIGS. 9 to 11 show detail enlargements of various embodiments of spacers.
Figure 10A:
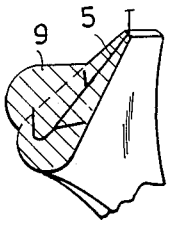
Figure 10:
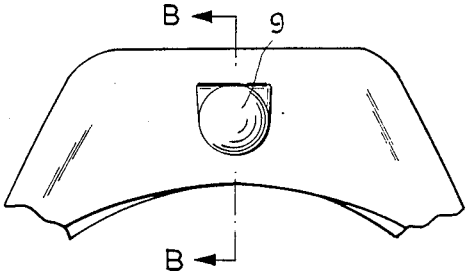
Figure 11A:
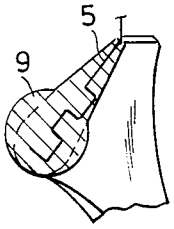
Figure 11:
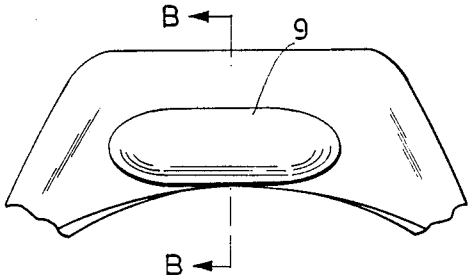

FIGS. 9, 10 and 11 show detail enlargements of the connecting portion with various designs of the spacer, and FIGS. 9A, 10A and 11A show sections along the line B—B in the corresponding FIGS. 9, 10 and 11.

It can, for instance, be seen in FIG. 9 that the spacer is ladder-shaped, consisting of three flange-like protrusions 11 spaced from each other and extending across the connecting portion 7. They decrease in height towards the tongue-root 8. In FIG. 10 the spacer consists of a central protrusion 9, and in FIG. 11 it consists of a relatively large transversely oriented elongate boss.

FIGS. 9A, 10A and 11A again show various embodiments of the tongue ensuring satisfactory attachment of the connecting portion.

Figure 12A:
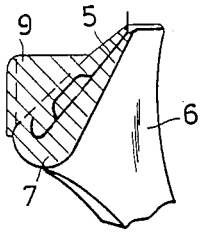
Figure 12:
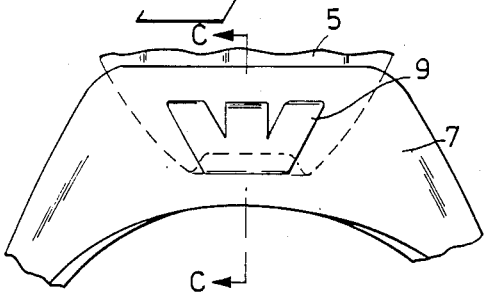
FIGS. 12 to 14 show detail enlargements of various embodiments of the joint between tongue and pulling member.
Figure 13A:
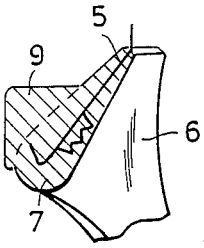
Figure 13:
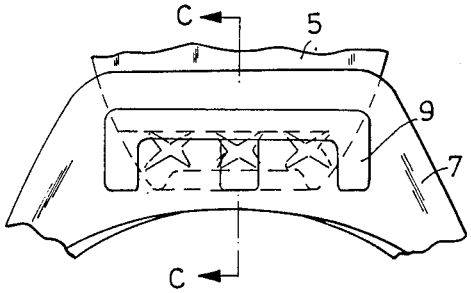
Figure 14A:
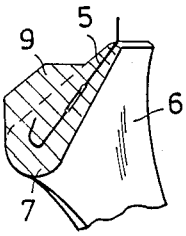
Figure 14:
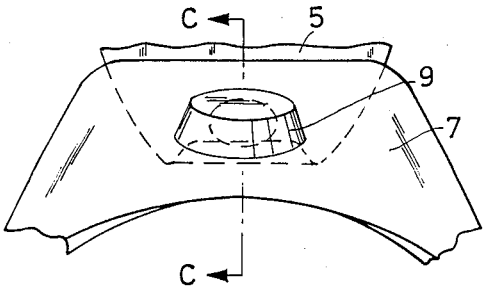

FIGS. 12, 13 and 14 show further detail enlargements of the actual connection between the tongue 5 and the connecting portion 7, with various embodiments of the spacer 9, i.e. FIGS. 12A, 13A and 14A are respective sections along the line C—C in FIGS. 12 to 14, showing further examples of suitable impressions of the tongue 5 with the object of achieving the desired joint resistance to tensile and torsional stresses.

Figure 15A:
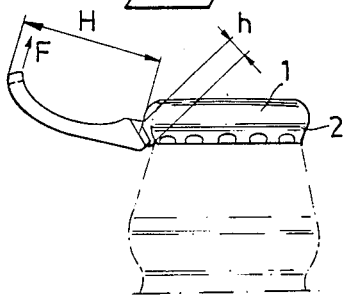
FIG. 15A shows the lever effect obtained during the opening process.
Figure 15:
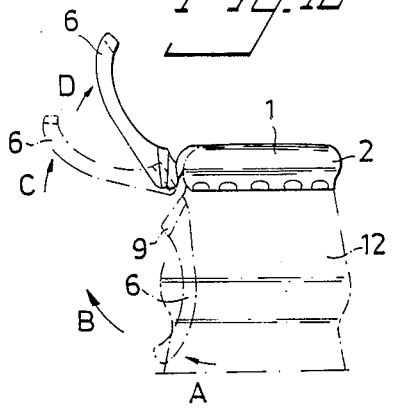
FIG. 15 shows, in perspective, a cap according to the invention during the opening process.

FIG. 15 shows a cap according to the invention in the process of being opened. A bottle neck is here designated 12. Before the cap is opened, the pulling member 6 abuts the neck of the bottle (see position A indicated by broken lines). When the cap is to be opened the pulling member 6 is lifted from the neck of the bottle in the direction of the arrow B, whereupon the spacer 9 is brought into contact with the cap skirt 2 (see position D of the pulling member 6 indicated by unbroken lines). A venting effect and controlled initial tearing of the score lines at the tongue-root are thus obtained between position C of the pulling member 6, indicated in broken lines, and position D. The force required to open the cap will thus be considerably less than for prior art caps, thanks to the leverage effect achieved according to the invention. When the initial score lines have thus been open in controlled and simple manner, it is extremely easy to continue tearing along the score lines so as to remove the cap from the bottle-opening.

FIG. 15A shows that the opening force will be many times lower since the lever arm H is several times greater than the lever arm h. This effect is also felt extremely noticeably in practice when opening caps provided with suitable spacers.

Considerably greater force is required to open conventional tear-off caps lacking the claimed spacer, and this easily leads to uncontrolled tearing.

The connection between the cap-tongue and the connecting portion of the pulling member also encases the metal tongue extremely well, particularly its side edges. The risk of cuts to a consumer handling the cap is thus practically eliminated. Since the connecting portion can also be made relatively large, the tongue embedded therein can also be made resistant to tensile and torsional stresses by means of various deformations and bendings.

The spacer according to the invention also offers other advantages, however, than that discussed in connection with FIG. 15.

Figure 16:
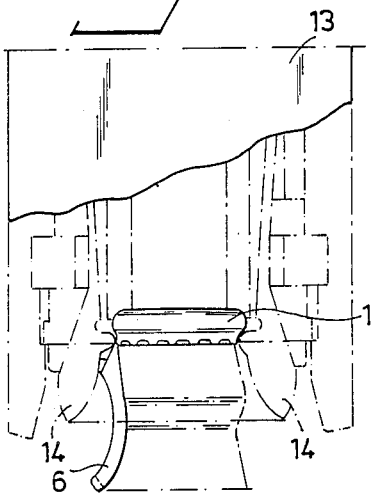
FIG. 16 shows a cap according to the invention during the capping process.

FIG. 16 shows the capping procedure using a cap according to the invention.

Figure 17:
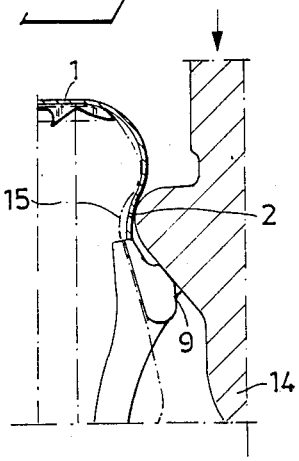
FIGS. 17 to 18 show detail enlargements of FIG. 16.
Figure 18:
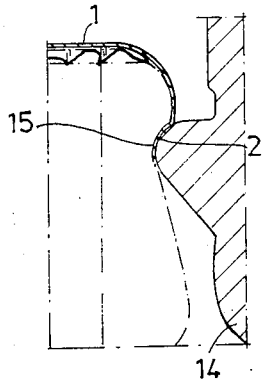

In FIG. 16 a bottle closing head is generally designated 13. The closing head 13 comprises a number of sealing fingers 14 which, in known manner, press the cap skirt 2 around the rim flange of the bottle during the capping process. The pressure of the sealing fingers lying within the region of the spacer can be reduced in controlled manner, giving the advantages described above, i.e. the advantages achieved by the cap skirt in this region gripping more loosely against the bottle. This eliminates the risk of the initial portion 10 of the score lines 4 becoming deformed or clenched and also creates the optimum conditions for venting effect. This can be seen even more clearly in the detail enlargement shown in FIG. 17 illustrating how a sealing finger 14 on its travel inwardly towards the cap is stopped by the operative surface of the spacer 9 so that a small gap is formed between the rim flange 15 of the bottle and the cap skirt 2. The grip is thus noticeably looser within the region of the spacer 9. As seen in the detail enlargement in FIG. 18, outside the operative region of spacer 9 the cap skirt 2 is clamped as usual below the flange 15 of the bottle.

Of course to achieve this the sealing fingers in the closing head sleeve, and the spacer, must be suited to the opening and to the neck of the bottle in order to achieve optimum effect. No deformation or clenching of the score lines will then be caused. However, as can be seen from FIG. 18, the other parts of the cap skirt 2, i.e. the parts lying outside the influence of the spacer, will be brought into close contact with the bottle rim flange.

The looser grip achieved below the rim flange around the mouth of the bottle also produces the venting effect so long striven after with such caps.

At present carbonated drinks in bottles sealed with various types of caps entail great problems. Particularly during warm weather an overpressure is easily generated, with the risk of the bottles exploding. Thanks to the partial weakening of the cap according to the invention, it has surprisingly proved possible to solve this venting problem.

Thus, a gentle pressure relief is obtained which eliminates the risk of caps flying off or of the bottles exploding.

Figure 19:
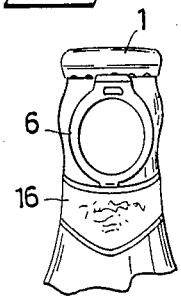
FIG. 19 shows a cap with guaranteed seal according to the invention.
Figure 20:
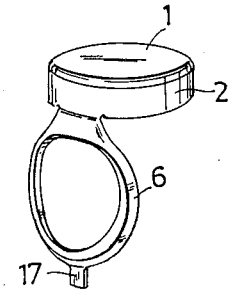
FIG. 20 shows a cap design for the guaranteed seal shown in FIG. 19.

FIG. 19 shows how the cap can be provided with a positioning means both retaining the pulling member in close contact with the neck of the bottle, and at the same time preventing unintentional opening of the easily opened score lines. The positioning means may be designed in various ways within the scope of the invention. This transport safety-device may consist of a positioning means 16 which, in the case shown, consists of an ordinary label covering the extension tab 17 protruding from the lower part of the pulling member (FIG. 20). Alternatively the label may cover the lower part of the pulling member. The transport safety-device can thus be supplied with no real additional cost. At the same time it provides proof for the consumer that no attempt has been made to open the cap. A double guarantee is thus obtained since the nipped-in cap skirt cannot be opened and re-sealed without this being obvious to the consumer.

Other features of the cap shown are that the score lines 4 in the top of the cap extend down over the skirt and thus define a tear-strip of which the tongue 5 is an extension, the tear-strip protruding from the cap skirt. According to a preferred embodiment, the tongue 5 has substantially the form of a truncated triangle, narrowing towards its free end. It should be pointed out that the tongue can be made extremely short and still adhere firmly to the pulling member. This offers an important and surprising saving in material, although not primarily due to its area being considerably less than other tongues but because it can be located in the part of the material which would otherwise be scrapped when punching out the cap blanks. The starting material is thus used to the full. Although this narrowing tongue shape is shown in all the embodiments, the invention is of course not limited thereto and it will readily be understood that any shape is possible.

According to the invention the tongue 5 is joined to a plastic pulling member, preferably in the form of a ring 6 having a connecting portion 7 in which the tongue is embedded. The ring 6 and connecting portion 7 are formed in a die comprising upper and lower mould parts with the tongue 5 projecting between these mould parts. Molten plastic is then allowed to fill the mould, and the plastic pulling member with the tongue embedded in it is then cooled before the mould parts are separated.

As can be seen in the drawings, the connecting portion 7 has considerably greater lateral extent than the tongue, and extends almost to the cap skirt 2. Since the tongue is covered on all sides, the risk of injuries occurring when the cap is opened is effectively prevented.

Since the pulling member is made of plastic it can more easily be given any desired shape. The hole for the finger can be shaped anatomically correctly to give a sure, comfortable grip. The ring need not necessarily be circular, but may rather be an oval shape conforming to the human finger. However, the finger hole should not be so large that the caps may become entangled during transport. The pulling member may also be shaped to fit close to the bottle, i.e. closely following the curve of the bottle in all directions so that it is well aligned against the bottle.

Since the pulling member is made of plastic its appearance can be varied in many ways. Materials of different colours may be used, as can transparent material or transparent material with gold flakes, for instance. Fluorescent or luminous materials are also possible. Furthermore, the surface of the pulling member may be structured, for instance giving it the appearance of leather.

It should be evident that the invention is not limited to the embodiments shown with score lines in the covering panel. The course of the score lines may of course be varied as desired in accordance with known designs.

According to a preferred embodiment of the invention, the tongue protruding from the cap skirt can be directed downwardly between manufacture and capping, i.e. at an angle of approximately 45°–90° to the covering plate, as against previously known techniques in which the tongue assumes an angle of approximately 0°–45° in relation to the covering plate, from manufacture to capping. This angle of the tongue, previously maintained throughout manufacture and storage, causes considerable problems when handling the cap blanks at the sorting stage and the tongue-root is thus repeatedly bent. This, as well as the final straightening of the tongue to a position substantially perpendicular to the covering plate upon application of the caps, has been found to weaken substantially the material at the root. In practice, therefore, this has resulted in undesired breakage when the cap is opened.

Of course it is within the scope of the invention for the pulling member to consist of metal. Furthermore, the entire connecting portion may serve as a spacer if it is given an appropriate thickness for this purpose. As to the sealing fingers, shown in FIG. 16 as imparting a corrugated finish to the crimped closure skirt by virtue of axially extending ribs formed on the surfaces of the sealing fingers which face radially inwardly of the closing head sleeve, these may of course be smooth.

I claim:

1. A tear-off closure for sealing a container, comprising an upper covering panel; a cylindrical cap skirt depending from said covering panel; score lines defining a tear-off strip in the covering panel and cap skirt, said tear-off strip continuing as a tongue protruding beyond the cap skirt; a pulling member connected to the tongue of the tear-off strip, said pulling member including a connecting portion having an outwardly directed side, being made of plastic, and being joined to the tongue of the tear-off strip to form between the tongue and the connecting portion a connection which is resistant to tensile and torsional stresses; and a spacer protruding from the outwardly directed side of the connection, said spacer having an operative surface spaced from the root of the tongue by a distance substantially less than the axial height of the cylindrical cap skirt.

2. A closure as claimed in claim 1, wherein the spacer consists of at least one protrusion.

3. A closure as claimed in claim 1, wherein the spacer consists of at least one shoulder extending substantially across the width of the connecting portion.

4. A closure as claimed in claim 1, wherein the height of the spacer from the plane of the tongue is from 1 to 5 mm.

5. A closure as claimed in claim 4, wherein said height is from 2 to 3 mm.

6. A closure as claimed in claim 1, wherein the pulling member, the connecting portion and the spacer are formed at the same time as the connecting portion is attached to the tongue.

7. A closure as claimed in claim 1, wherein in order to ensure secure anchoring to the connecting portion, the tongue is provided with formations such as through-holes, protruding flanges and barbs.

8. A closure as claimed in claim 1, wherein the connecting portion entirely surrounds the tongue and extends to the vicinity of the tongue root.

9. A closure as claimed in claim 1, wherein, from manufacture of the closure blank to container closing, the tongue is positioned at an angle of about 45°–90° in relation to the covering panel.

10. A closure as claimed in claim 9, wherein the tongue is slightly curved to facilitate the positioning of the tongue during handling of the blank.

11. A closure as claimed in claim 1, when mounted on a bottle neck, and including a breakable positioning member at least partially covering the pulling member to restrain the pulling member in contact with the bottle-neck until the moment of use.

12. A closure as claimed in claim 11, including a protruding, relatively thin tab on the pulling member and intended to lie against the bottle, the positioning member overlapping said tab.

13. A closure as claimed in claim 11, wherein said positioning member overlaps at least the end portion of the pulling member opposite to the skirt.

14. A closure as claimed in claim 11, wherein the pulling member is made of plastic and is manufactured in one piece with the connecting portion.

* * * * *